US007604430B2

(12) United States Patent
Pervan

(10) Patent No.: US 7,604,430 B2
(45) Date of Patent: Oct. 20, 2009

(54) ASSEMBLY FOR PREVENTING THE VEHICLE PASSAGE

(76) Inventor: Boris Pervan, Laniste 5, 10000 Zagreb (HR)

( * ) Notice: Subject to any disclaimer, the term of this patent is extended or adjusted under 35 U.S.C. 154(b) by 67 days.

(21) Appl. No.: 11/568,355

(22) PCT Filed: Apr. 20, 2005

(86) PCT No.: PCT/HR2005/000027

§ 371 (c)(1),
(2), (4) Date: May 14, 2007

(87) PCT Pub. No.: WO2005/103388

PCT Pub. Date: Nov. 3, 2005

(65) Prior Publication Data

US 2007/0227071 A1 Oct. 4, 2007

(30) Foreign Application Priority Data

Apr. 26, 2004 (HR) ..... P 20040368 A

(51) Int. Cl.
*E06B 5/01* (2006.01)
*E01F 13/04* (2006.01)

(52) U.S. Cl. ..... 404/6; 49/33; 49/49

(58) Field of Classification Search ..... 49/33, 49/49, 131, 332, 347; 404/6; 14/53
See application file for complete search history.

(56) References Cited

U.S. PATENT DOCUMENTS 815,663 A * 3/1906 Walker et al. ..... 43/69
1,217,381 A * 2/1917 Zubryd ..... 43/59
1,345,145 A * 6/1920 Dominguez ..... 119/416
2,643,010 A * 6/1953 Hott et al. ..... 414/584
3,017,146 A * 1/1962 Wagner ..... 244/114 B
4,554,695 A 11/1985 Rowland
4,576,509 A * 3/1986 Beaty, Sr. ..... 404/6
4,647,246 A * 3/1987 Brink et al. ..... 404/6
5,374,154 A * 12/1994 Alten ..... 414/537
5,975,791 A * 11/1999 McCulloch ..... 404/6
7,214,000 B2 * 5/2007 Marsh et al. ..... 404/6

FOREIGN PATENT DOCUMENTS

EP 0267343 5/1988
FR 2739637 4/1997

* cited by examiner

*Primary Examiner*—Gary S Hartmann
(74) *Attorney, Agent, or Firm*—Brooks Kushman P.C.

(57) ABSTRACT

The assembly of the mobile swing-gate is installed in the channel that is dug across the entire width of the road, and the sides of the excavation are reinforced by wall (5). The created recess is over-bridged by swing-gate (1). One side of swing-gate (1) is connected onto joint (2) that is fixed onto channel wall (5). The opposite side of swing-gate (1) is supported by support grate (3) that by its upper side leans against swing-gate (1) and by its lower side against the corner of wall (5). Steel rope (4) is attached at the upper side of the support grate. By pulling steel rope (4) the support grate (3) eludes bellow swing-gate (1) that remains without support at that side, rotates about joint (2) and falls into the channel, and in such a way a recess is opened in the road.

9 Claims, 8 Drawing Sheets

CROSS-SECTION C-C

ASSEMBLY FOR PREVENTING THE VEHICLE PASSAGE

Figure 1:
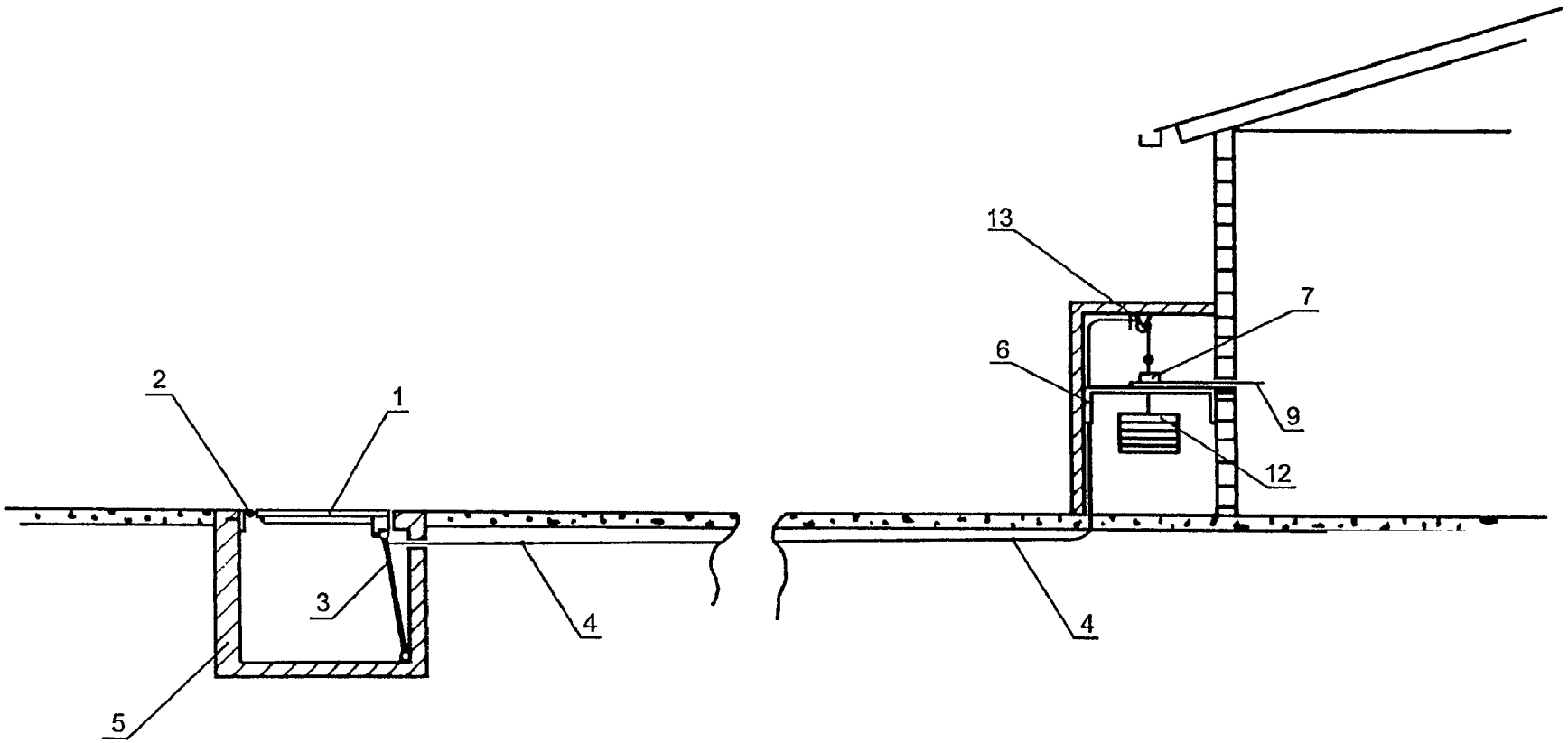

This invention is related to the system for the security of objects, by which the vehicle access towards the secured object by the traffic road can be selectively prevented, and in accordance with the international patent classification (IPC) it can be classified as:

INVENTION RELATED FIELD

The invention is related to the field of securing the objects from the access of undesired vehicles in the vicinity of the protected object, precisely; by means of it the approach of an undesired vehicle to the secured object by the access road is prevented.

TECHNICAL PROBLEM

The objects, for which the security protection is required, have the survey and selection of the vehicle access to the object, and for this purpose various systems are used by which the approach of undesired vehicles to the protected object by the access road is tried to be prevented. Then, the checking of all coming vehicles is made for the security reasons, and, after the checking, some of them are let through. But, sometimes a vehicle that is not let through tries by force to approach the protected object. The intrusion of such vehicles is tried to be prevented in various ways.

STATE-OF-ART

The access roads to the protected object are secured in several ways from the approach of undesired vehicles that pass the check-point by force: by additional security positions set along the access road; by barriers placed on the access road, which decelerates the drive; and by various devices for piercing and damaging the vehicle tyres. Such devices are placed along the road and, if necessary, are placed across the road in various ways in order to prevent or decelerate the motion of the undesired vehicle.

DISCLOSURE OF THE INVENTION ESSENCE

The invention Assembly for preventing the vehicle passage is assigned for installing in the roads where the vehicle traffic is checked and, after checking, the passage is permitted only to certain vehicles, and it is assigned for the total passage prevention of all vehicles that try by force to pass by this road, in a simple manipulation way, without the use of complicated assemblies and electronics, without the need and dependence on any kind of energy source and at a simple checking of the assembly correctness, and after that the assembly is quickly and simply set in the position by which the vehicle passage is again possible.

The assembly for preventing the vehicle passage consists of the swing-gate assembly by which the vehicle passage is prevented and of the assembly for its activating.

The swing-gate assembly consists of swing-gate (1) by which the recess in the road is covered, the channel that is dug through the entire road width and reinforced by wall (5), joint (2) that is attached to the channel wall (5) dug in the road, support grate (3) that supports swing-gate (1), and of steel rope (4) by which support grate (3) is dragged.

The activating assembly consists of assembly carrier (6), roller (7), and little rollers (8) that hold back roller (7), mobile plates (9), weight (12) and pulley (13).

At the moment when some vehicle tries to pass by force the road on which the invention Assembly for preventing the vehicle passage is installed, it is sufficient to pull mobile plate (9), by that weight (12) that drags steel rope (4) is liberated, and the latter eludes support grate (3). When the support grate eludes below swing-gate (1), it stays without support on one end so that it rotates about joint (2) and falls into the channel. In such a way, in a short time a recess is opened that prevents the vehicle passage. If the vehicle approaches at a great speed, then the front wheels fall into the channel causing the wheel breaking.

This invention introduces the possibility of a quick, efficient and total prevention of the vehicle passage across the road into which the invention is installed. The invention is not dependent on any energy source; it is resistant to temperature differences and to pollution. It is simple to use, it does not require any special training for manipulation, and it does not require the maintenance and enables a simple regular work survey. And, after the work survey, the assembly is quickly and easily again disposed into the position, where the vehicle passage is enabled.

In such a way, by this invention the technical novelties with respect to the present state-of-art are introduced.

SHORT DESCRIPTION OF DRAWINGS

FIG. 1 Disposition scheme of the assemblies for preventing the vehicle passage.

Figure 2:
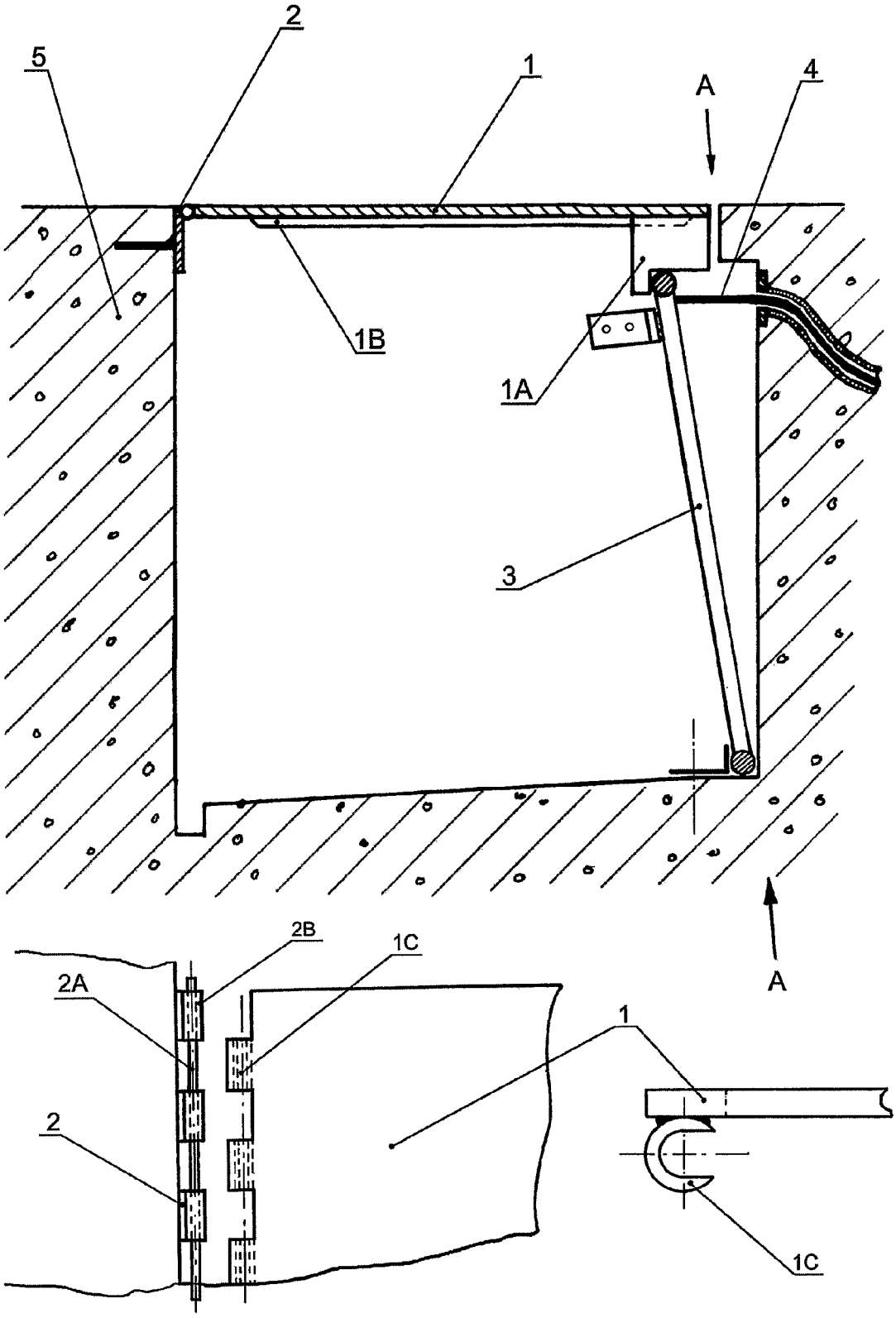

FIG. 2 Lateral cross-section of the swing-gate assembly in the position when the vehicle passage is enabled.

Figure 3:
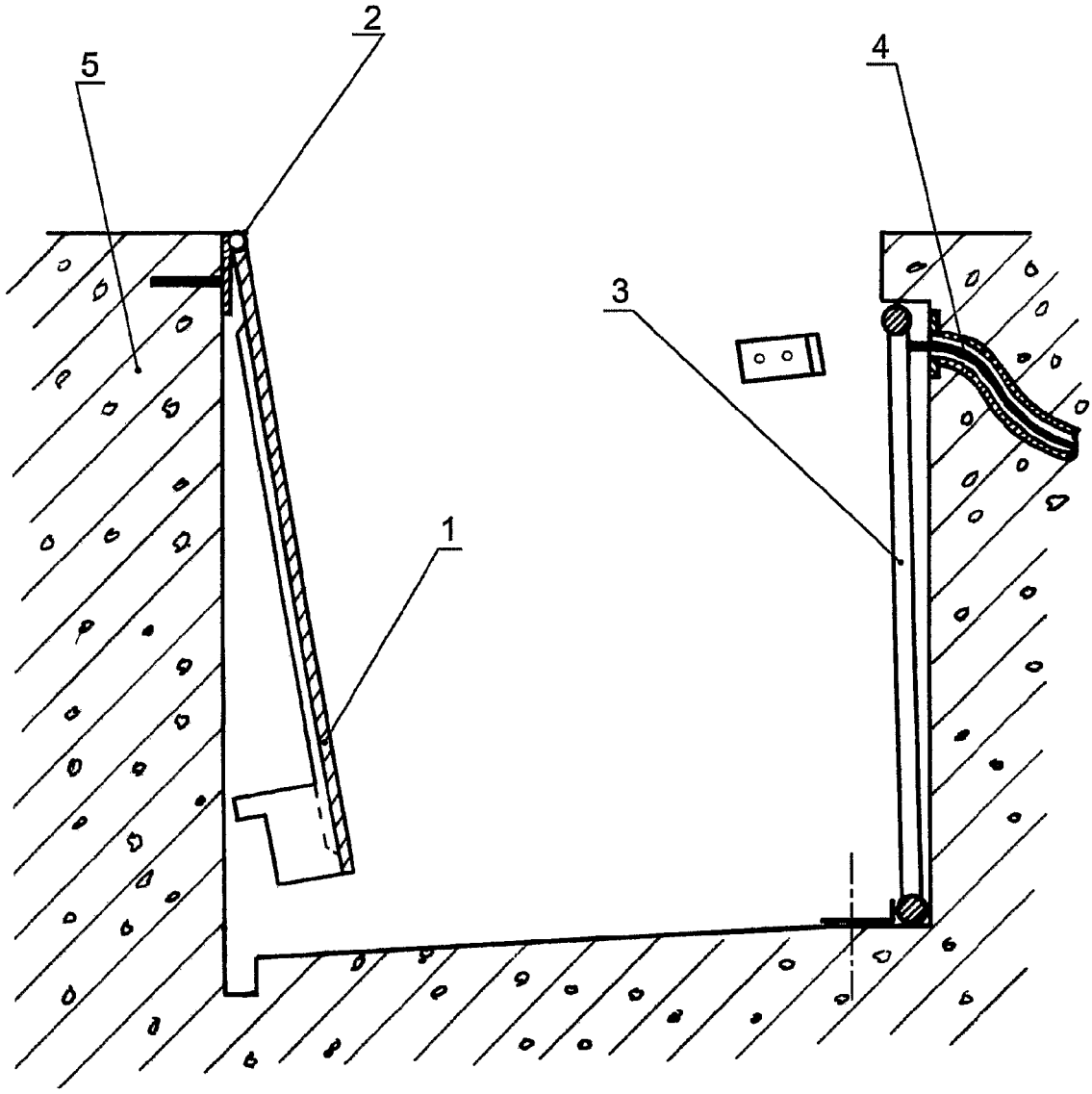

FIG. 3 Lateral cross-section of the swing-gate assembly in the position when the vehicle passage is prevented.

Figure 4:
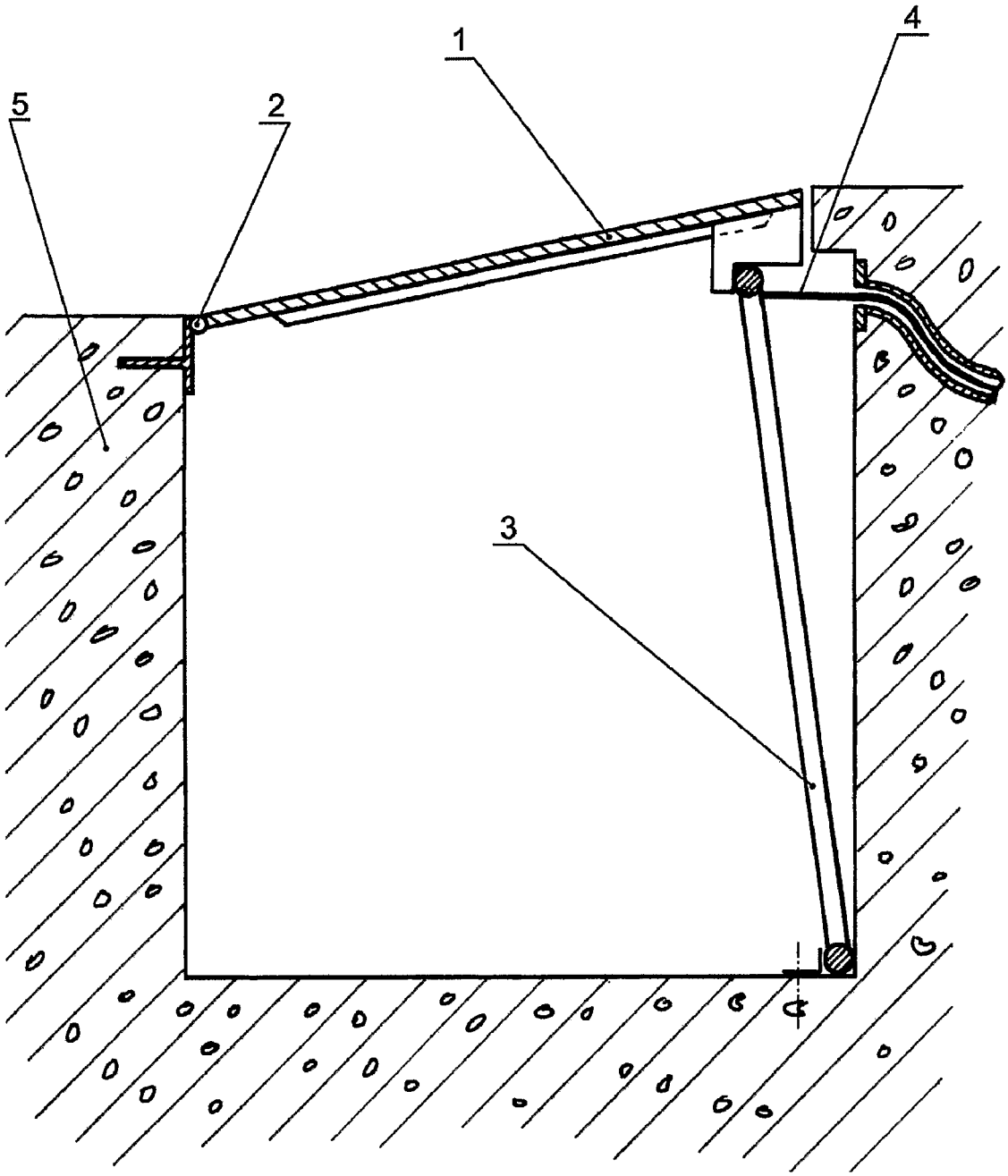

FIG. 4 Lateral cross-section of the swing-gate assembly in the position when the vehicle passage is enabled, and the assembly is installed in the road where the vehicles arriving at high speed could be expected.

Figure 5:
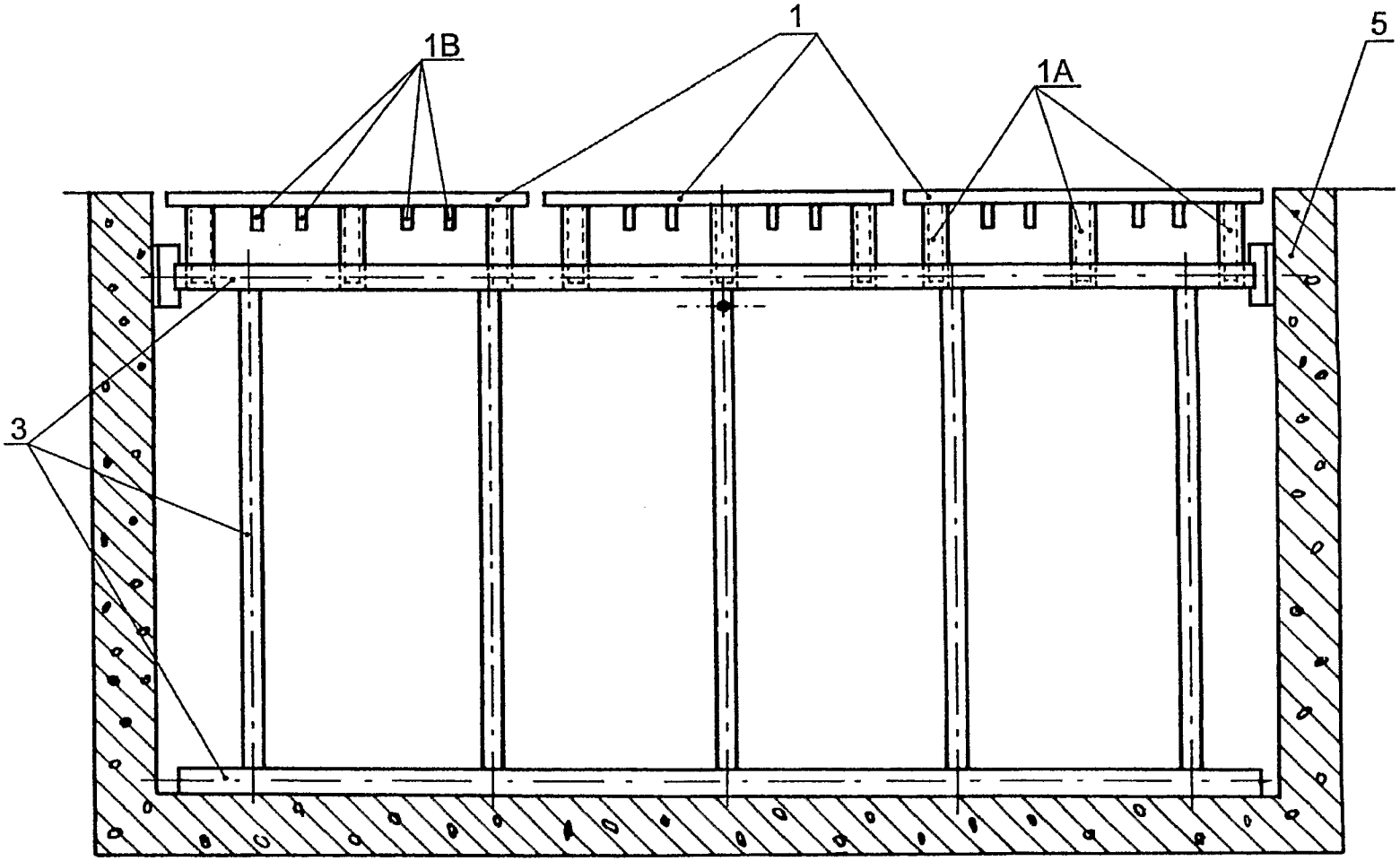

FIG. 5 Cross-section A-A. Front view of the swing-gate assembly.

Figure 6:
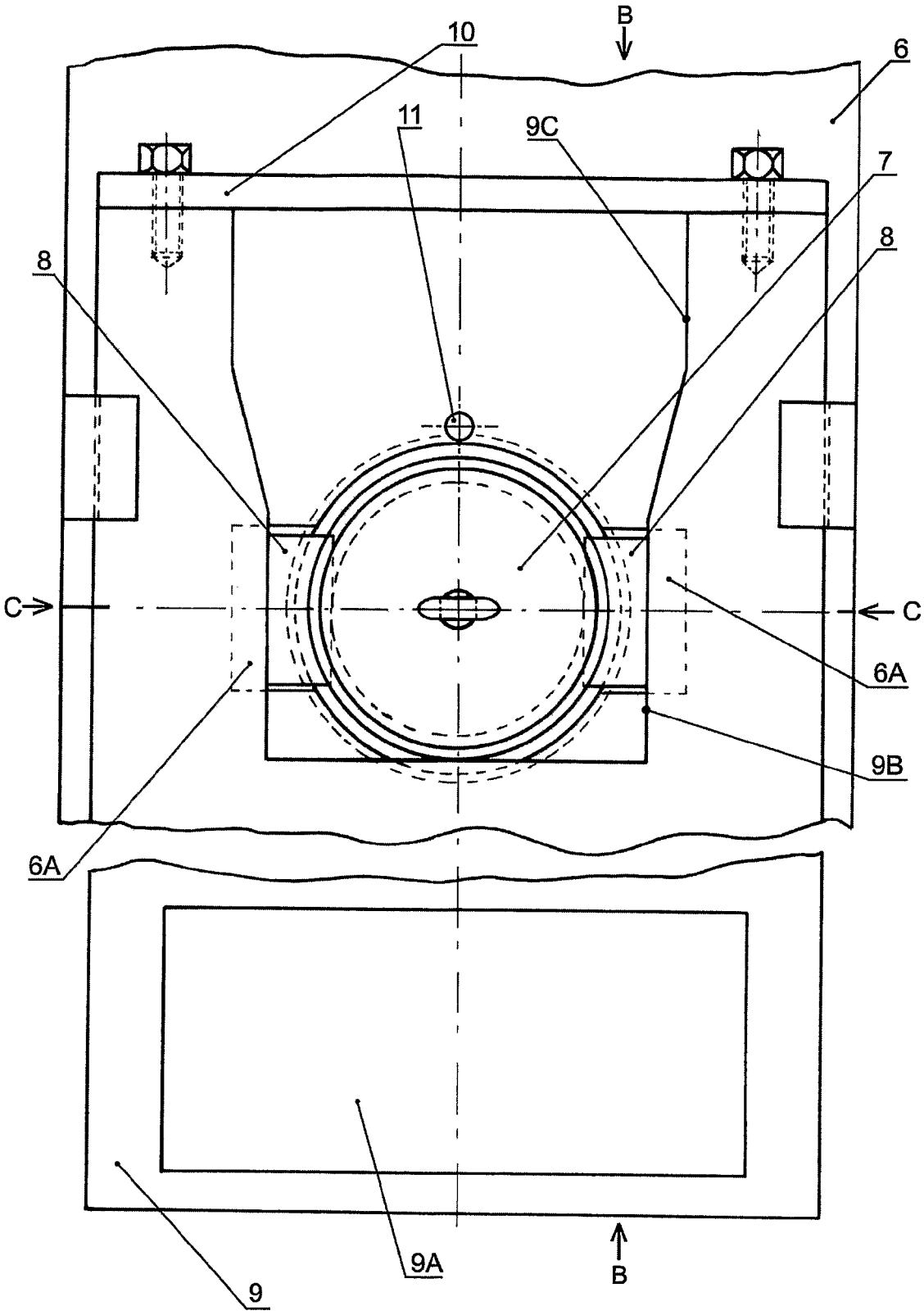

FIG. 6 Drawing of the assembly for activating the swing-gate.

Figure 7:
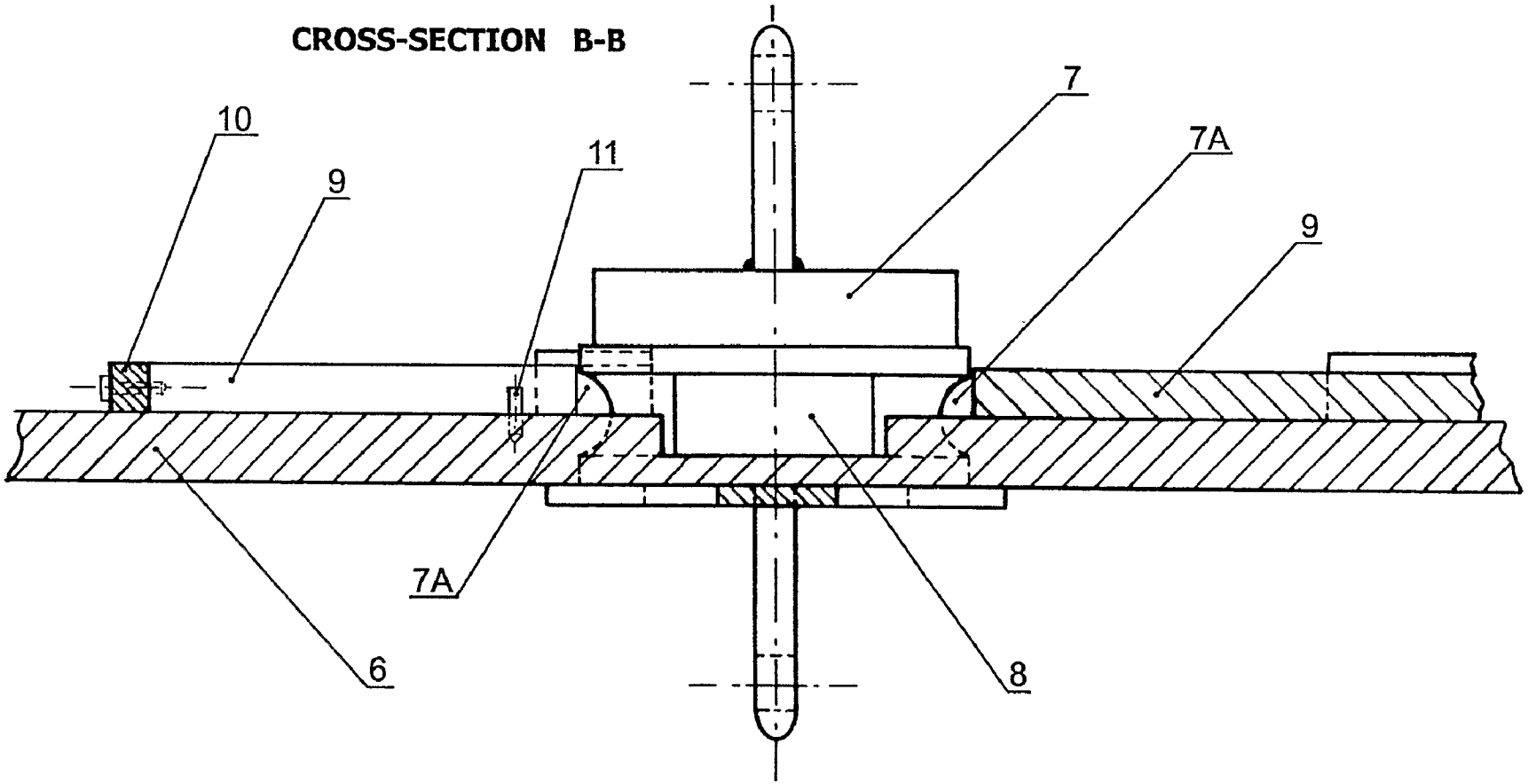

FIG. 7 Cross-section B-B. Front view of the assembly for activating the swing-gate.

Figure 8:
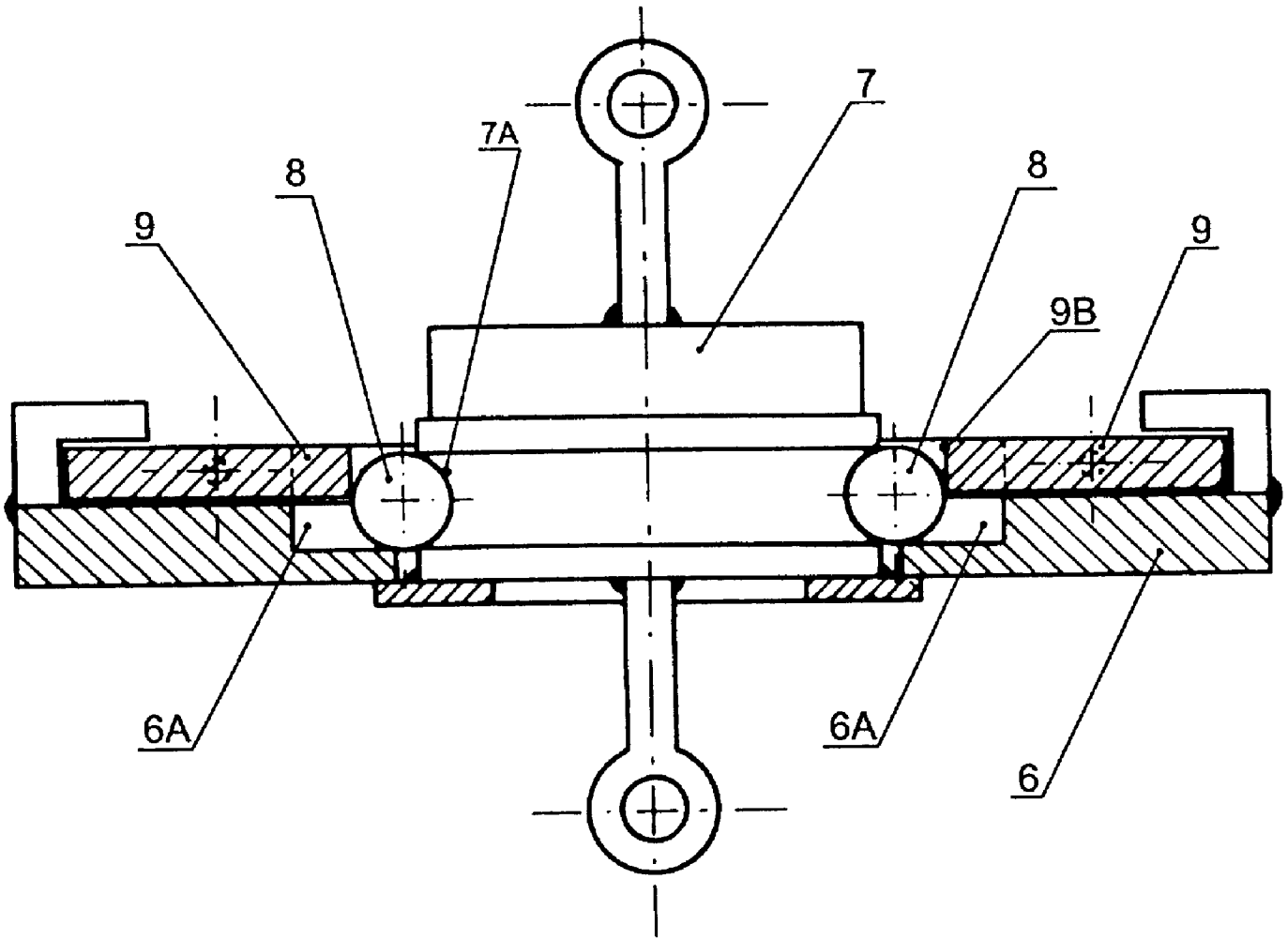

FIG. 8 Cross-section C-C. Lateral cross-section of the assembly for activating the swing-gate.

DETAILED DESCRIPTION OF THE INVENTION REALISATION

The assembly for preventing the vehicle passage is assigned to be installed in the roads with the purpose of preventing the vehicle passage. It consists of the swing-gate assembly and the activating assembly. The scope of the invention is that on the road, on which the traffic is carried out disturbless and without retardation, in a very short time, without using any energy sources and complex assemblies, the passage of all wheel-running vehicles is prevented safely and efficiently.

FIG. 1

Disposition Scheme of the Assembly for Preventing the Vehicle Passage

The assembly of the swing-gate is set into the channel that is dug through the entire road width. The excavation is reinforced by wall (5) made of strong material. The recess created by digging through the channel is over-bridged by swing-gate (1). One side of swing-gate (1) is attached onto joint (2) that is fastened into channel wall (5). The other end of swing-gate (1) is supported by support grate (3), which leans by its upper side against swing-gate (1) and by its lower side against the corner of support wall (5). At the upper side of the support grate, steel rope (4) is attached. By pulling steel rope (4) support grate (3) eludes bellow swing-gate (1), which remains without support on that side, rotates about joint (2), falls into the channel and in such a way opens the recess in the road, which is sufficiently wide to prevent the vehicle passage.

The pulling of steel rope (4) is possible to be done manually too, but, when on the road several swing-gate assemblies are set, then also the assembly for activating the swing-gate can be used. Then the energy of the weight fall is used. This gives a great security at using the swing-gate assembly, because, due to the action of low temperatures, humidity, corrosion, accumulated dirt or sand, it could come to a stoppage at work when steel rope (4) is pulled manually.

The assembly for activating the swing-gate consists of assembly carrier (6) that is fixed onto the wall of the casing, roller (7), small rollers (8), mobile plate (9), coupler (10), weight (12) and pulley (13).

When mobile plate (9) is manually dragged, roller (7) is unlocked, and weight (12) falls down and pulls steel rope (4) that eludes support grate (3).

FIG. 2

Lateral cross-section of the swing-gate assembly in the position when the vehicle passage is enabled.

The swing-gate assembly for preventing the vehicle passage is set in the channel that extends by the entire width of the road. The excavation is reinforced by wall (5) made of a strong material. The recess created by the channel digging-through is over-bridged by swing-gate (1) that could have ribbed supplements (1B) at the lower side to increase the carrying capacity. Plates (1A), which serve for the supporting of support grate (3), are attached at the front side of the swing-gate, and pipe (1C), which is round and with a slot on the front side to enable the disposing of swing-gate (1) on the shaft of joint (2A), is attached at the other side of swing-gate (1). Through pipe (1C) and pipe (2B) shaft (2A) is pulled through, by means of which swing-gate (1) is connected with joint (2) in a way that swing-gate (1) can freely rotate about joint (2) that is fixed in channel wall (5). The opposite side of swing-gate (1) is supported by support grate (3), which by its upper side leans against swing-gate (1) and plate (1A), and by its lower side against the corner of support wall (5). Steel rope (4) is attached at the upper side of support grate (4). At this position of the swing-gate, the traffic on the road is safe and disturbless.

FIG. 3

Lateral cross-section of the swing-gate assembly in the position when the vehicle passage is prevented.

The assembly of the swing-gate is set in the channel that is dug through the entire width of the road. The recess created by the digging is over-bridged by swing-gate (1). One side of swing-gate (1) is attached to joint (2), while the opposite side of swing-gate (1) is supported by support grate (3), which by its upper side leans against swing-gate (1) and plates (1A) that are fixed to swing-gate (1), and by its lower side the support grate (3) leans against the corner of support wall (5). Steel rope (4) is attached at the upper side of the support grate. By pulling steel rope (4), support grate (3) eludes bellow swing-gate (1), which remains without a support on that side, rotates about joint (2), falls into the channel and in such a way opens the recess on the road that is sufficiently wide to prevent the vehicle passage. If the vehicle approaches by a great speed, the front wheels will fall into the channel and it comes to the wheel breaking.

FIG. 4

Lateral cross-section of the swing-gate assembly in the position when the vehicle passage is enabled and when the assembly is installed into the road, where the approach of a high speed vehicle is expected.

If there exists a possibility that the vehicle that tries to approach by force the secured object will develop a great speed of motion on the road that is secured by the assembly for preventing the passage, and it is expected that the recess width on the road is not sufficient, then the side of the channel that is opposite from the vehicle approaching direction should be made in a way, that it is somewhat higher, i.e. elevated from the road level. In such a way, the passage is prevented even of those vehicles, which could develop a great speed before reaching the swing-gate and in such a way try to approach the protected object.

FIG. 5

Cross-section A-A. Front view of the swing-gate assembly.

The assembly of the swing-gate is set in the channel that is dug through the entire road width. The excavation is reinforced by wall (5) made of a strong material. The recess created by the channel digging on the road is over-bridged by swing-gate (1) that is supported by support grate (3). Swing-gate (1) can have ribbed supplements (1B) on the lower side for increasing the carrying capacity. Plates (1A) are attached at the front side of the swing-gate, which serve for supporting support grate (3). Support grate (3) by its upper side leans against swing-gate (1), and by its lower side against the corner of support wall (5). Steel rope (4) is attached at the upper side of the support grate. By pulling steel rope (4), support grate (3) eludes bellow swing-gate (1) that remains without support and falls into the channel. In such a way a recess in the road is created, which is sufficiently wide to prevent the vehicle passage.

FIGS. 6, 7 and 8

Front views and cross-sections of the swing-gate activating assembly.

The assembly for activating the swing-gate consists of assembly carrier (6) that is fixed to the casing walls, roller (7), two little rollers (8), mobile plate (9), coupler (10) that closes mobile plate (9), limiter (11) that puts limitations to the motion of mobile plate (9) during its dragging, weight (12) and pulley (13). The assembly serves to liberate weight (12) after pulling mobile plate (9), which falls down and pulls steel rope (4) that moves support grate (3).

The assembly for activating the swing-gate works in the following way: assembly carrier (6) has a bore in the middle, into which enters roller (7). Two grooves (6A) are made around the bore, into which little rollers (8) are placed. The depth of grooves (6A) is approximately of the same size as the diameter of little rollers (8), and the length of grooves (6A) is equal to the diameter of little rollers (8). Roller (7) has made semi-circular groove (7A) on its periphery, into which enter little rollers (8). Groove (7A) is of semi-circular shape, but somewhat shallower than the diameter of little rollers (8). Mobile plate (9) has made opening (9A) for dragging the plate manually at one side and slot (9B and 9C). The slot is narrower at its upper part (9B) and widens at its lower part (9C). The slot width on its narrower part (9B) is equal to the sum of diameters of groove (7A) and two diameters of little rollers (8). So, when roller (7) is positioned in the height of assembly carrier (6), little rollers (8) enter into groove (7A) of roller (7), and mobile plate (9) presses little rollers (8) and keeps them into groove (7A) of roller (7). In such a way, roller (7) is fixed, i.e. locked to assembly carrier (6). The slot (9C) on mobile plate (9) is wider in its lower part, permitting the rolling of little rollers (8) along grooves (6A) on assembly carrier (6).

When the assembly for activating is in the position that weight (12) is lifted and swing-gate (1) on the road is in the horizontal position, then mobile plate (9) is in the position when the wall of opening (9B) on it keeps little rollers (8) in groove. By dragging mobile plate (9) onto the height level of little rollers (8), the wider part of opening (9C) arrives, so that little rollers (8) pressed by the slope of groove (7A) come out of it.

In such a way, roller (7) is liberated. Weight (12) attached to it pulls it downwards, and it pulls steel rope (4) attached on the upper side of roller (7), so that steel rope (4) via pulley (13) drags support grate (3).

The invention claimed is:

1. Assembly for preventing vehicle passage across an access road having an elongate open top excavated trench formed transversely thereacross, the assembly comprising:

an elongate swing-gate sized to fit within at least a portion of the open top trench, the swing-gate having a first side, a second side as well as a upper side and a lower side;

a fixed support to be located at a first edge of the open top trench;

a movable support supporting the second side, the movable support having an upper end and a lower end;

where the first side of the swing-gate is mounted to the fixed support and the movable support supports the lower side of the swing-gate adjacent to the second side, and the lower end of the movable support stands on the bottom of the excavation; and a flexible tensile member connected to the movable support, where the flexible tensile member is activated by an activating assembly, the activating assembly including a movable plate defining a slot therethrough and having a bottom surface and a carrier having a top surface, where at least one groove is formed on the top surface and the carrier defines an opening therein, and where the bottom surface of the moveable plate is slideably connected to the top surface of the carrier, the activating assembly further comprising at least one roller which cooperates with the slot of the movable plate and the groove of the carrier so that when the activating assembly activates the tensile member, the movable support no longer supports the second side of the swing-gate, allowing the swing-gate to fall into the excavation, preventing vehicle passage from both directions.

2. The assembly of claim 1, wherein the carrier is tubular and the tensile member is placed into the carrier.

3. The assembly of claim 1, further comprises two small rollers which are placed in the groove on the top surface of the carrier.

4. The assembly of claim 3 wherein the groove depth is equal to the radius of the small rollers and the groove length is equal to the diameter of small rollers.

5. The assembly of claim 1 further wherein the roller serves to enable the locking and unlocking of the activation assembly, the roller having an upper and lower side and on its periphery having a semi-circular groove where the diameter of the semi-circular groove is shallower than the radius of the small rollers, and on the roller upper side the tensile member is attached, and on the lower side of roller the weight is attached.

6. The assembly of claim 1, wherein the slot on the moveable plate has a narrow upper part and a wider lower part.

7. The assembly of claim 1, further comprising a coupler for stopping the motion of moveable plate so that the moveable plate would not be entirely drawn out, where the coupler is attached to the moveable plate by at least one screw.

8. The assembly of claim 1, further comprising a limiter for stopping the motion of moveable plate so that the coupler would not reach the groove and stop the motion of the roller, where the limiter is attached near the opening on the assembly carrier.

9. The assembly of claim 1, further comprising a weight to pull the tensile member after the roller has been liberated and in turn to move the moveable support where the weight is attached to the lower side of the roller.

* * * * *